US006625935B1

(12) United States Patent
King et al.

(10) Patent No.: US 6,625,935 B1
(45) Date of Patent: Sep. 30, 2003

(54) PARTITION SYSTEM WITH WORKTOOLS

(75) Inventors: Jonathan J. King, East Grand Rapids, MI (US); Joel T. Ruiter, Grand Haven, MI (US); David J. Dekkar, Holland, MI (US); James D. Houda, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 130 days.

(21) Appl. No.: 09/693,316

(22) Filed: Oct. 20, 2000

(51) Int. Cl.[7] ..... E04B 2/74

(52) U.S. Cl. ..... 52/36.6; 52/36.1; 52/239; 52/243

(58) Field of Search ..... 52/36.1, 239, 36.6, 52/220.7, 220.8, 243; 312/194, 195, 225.6, 223.3, 223.2; 108/42, 47, 48, 50, 106–109, 144

(56) References Cited

U.S. PATENT DOCUMENTS

| | | | | | |
|---|---|---|---|---|---|
| 2,812,220 | A | | 11/1957 | King | |
| 3,164,353 | A | | 1/1965 | René | |
| 3,213,965 | A | | 10/1965 | Fedoryk | |
| 3,983,822 | A | | 10/1976 | Suttles | |
| 4,204,480 | A | | 5/1980 | Hanna | |
| 4,415,091 | A | | 11/1983 | Wolff | |
| 4,455,007 | A | | 6/1984 | Varon et al. | |
| 4,467,925 | A | | 8/1984 | Ratzloff et al. | |
| 4,508,300 | A | | 4/1985 | Minick | |
| 4,542,832 | A | | 9/1985 | Minick et al. | |
| 4,605,988 | A | | 8/1986 | Nienhuis et al. | |
| 4,685,255 | A | * | 8/1987 | Kelley | 52/36 |
| 4,876,835 | A | * | 10/1989 | Kelley et al. | 52/239 |
| 4,914,873 | A | | 4/1990 | Newhouse | |
| 4,928,832 | A | | 5/1990 | Overmann | |
| 4,953,879 | A | | 9/1990 | Cain et al. | |
| 5,038,539 | A | * | 8/1991 | Kelley et al. | 52/239 |
| 5,160,154 | A | | 11/1992 | Seydel et al. | |
| 5,197,614 | A | | 3/1993 | Dalton et al. | |
| 5,464,104 | A | | 11/1995 | McArthur | |
| 5,472,103 | A | | 12/1995 | Merl | |
| 5,660,286 | A | | 8/1997 | Shea | |
| 5,738,019 | A | | 4/1998 | Parker | |
| 5,769,248 | A | | 6/1998 | Johnson | |
| 5,890,325 | A | * | 4/1999 | Cocorran et al. | 52/36.1 |
| 5,910,351 | A | | 6/1999 | Davis et al. | |
| 5,943,834 | A | | 8/1999 | Jeffers et al. | |
| 5,955,170 | A | | 9/1999 | Davis et al. | |
| 5,957,422 | A | | 9/1999 | Shea | |
| 5,970,662 | A | * | 10/1999 | Cocorran et al. | 52/36.1 |
| 5,976,663 | A | | 11/1999 | Davis et al. | |
| 5,979,118 | A | * | 11/1999 | Gortsema et al. | 52/36.1 |
| 5,989,676 | A | | 11/1999 | Davis et al. | |
| 6,044,612 | A | | 4/2000 | Shipman et al. | |
| 6,070,747 | A | | 6/2000 | Shea | |
| 6,082,065 | A | | 7/2000 | Feldpausch | |
| 6,161,347 | A | | 12/2000 | Yu et al. | |
| 6,164,467 | A | | 12/2000 | DePottey et al. | |
| 6,173,543 | B1 | * | 1/2001 | Gortsema et al. | 52/220.7 |
| 6,330,773 | B1 | * | 12/2001 | MacDonald et al. | 52/239 |

FOREIGN PATENT DOCUMENTS

| | | | |
|---|---|---|---|
| WO | WO0021412 | * | 10/1999 |

* cited by examiner

*Primary Examiner*—Carl D. Friedman
*Assistant Examiner*—Yvonne M. Horton
(74) *Attorney, Agent, or Firm*—Price, Heneveld, Cooper, DeWitt & Litton

(57) ABSTRACT

A partition panel for offices includes a partition frame having a horizontal frame member and a pair of horizontally spaced apart vertical frame members connected to the horizontal frame member. An accessory support is connected to the horizontally extending frame member at a selected one of a plurality of locations to permit adjustable connection of the accessory support to the horizontal frame member. The accessory support includes a plurality of vertically spaced apart connectors adapted to support an accessory unit at a selected one of a plurality of vertically spaced locations. An accessory unit is removably connected to the accessory support at a selected one of the vertically spaced apart connectors.

13 Claims, 5 Drawing Sheets

PARTITION SYSTEM WITH WORKTOOLS

BACKGROUND OF THE INVENTION

Modern offices are becoming increasingly complicated and sophisticated due largely to the ever increasing needs of the users for improved utilities support at each workstation, such as communications, computers and other types of data processors, electronic displays, etc., including physical accommodations, such as lighting, HVAC, security, and the like. For example, modern offices for highly skilled "knowledge workers" such as engineers, accountants, stock brokers, computer programmers, etc., are typically provided with multiple pieces of very specialized computer and communications equipment that are capable of to processing information from numerous local and remote data resources to assist in solving incredibly complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will find their place in the workplaces of the future.

One important consequence of the advent of sophisticated electronic offices is the increased need and desirability for distributing utilities throughout the various offices in a manner which can be readily reconfigured. The term "utilities" as used herein incorporates a wide variety of facilities for use at a workstation, including security devices, electrical power, signal and/or communications, HVAC, water and other fluids, and other similar resources. The ability to provide the worker with ready access to all of these utilities is clearly advantageous in the quest to promote worker well being and effectiveness.

The efficient use of building floor space is also an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent leasehold improvement.

In order to gain increased efficiency in the use of expensive office real estate, attempts are now being made to try to support high paid knowledge workers with these types of modular furniture systems in open office settings, instead of conventional private offices. However, in order to insure peak efficiency of such knowledge workers, the workstations must be equipped with the various state-of-the-art utilities and facilities discussed above. Since such workstations must be readily reconfigurable to effectively meet the ever changing needs of the user, the distribution and control of utilities throughout a comprehensive open office plan has emerged as a major challenge to the office furniture industry.

Such partition systems may include various worktools such as shelves, document supports, and the like. However, such worktools may be limited in terms of adjustability, such that the workspace cannot be readily reconfigured. Furthermore, for some applications, the partition frames may be utilized without cover panels. In such situations, the ability to provide worktools to support the user may be limited.

SUMMARY OF THE INVENTION

One aspect of the present invention is to provide a partition panel for offices including a partition frame having a horizontal frame member and a pair of horizontally spaced apart vertical frame members connected to the horizontal frame member. An accessory support is connected to the horizontally extending frame member at a selected one of a plurality of locations to permit adjustable connection of the accessory support to the horizontal frame member. The accessory support includes a plurality of vertically spaced apart connectors adapted to support an accessory unit at a selected one of a plurality of vertically spaced locations. An accessory unit is removably connected to the accessory support at a selected one of the vertically spaced apart connectors.

Another aspect of the present invention is a partition for offices including a partition frame having a base configured to abuttingly support the partition frame freestanding on a floor surface. The partition frame further includes a pair of vertically extending frame members and a horizontal frame member extending therebetween. Each vertically extending frame member has a vertical row of openings, and the partition frame has an enlarged opening therethrough between the vertically extending frame members and below the horizontal frame member. A horizontal brace extends across the enlarged opening below the horizontal frame member. The horizontal brace is releasably connected to selected ones of the vertical row of openings. A vertical accessory support member is connected to the horizontal frame member, and extends across and abuts the horizontal brace.

Yet another aspect of the present invention is a partition including a generally rectangular partition frame having a horizontal frame member and an opening through a central portion of the partition frame below the horizontal frame member. A horizontal brace is secured to the partition frame, and extends across the opening. An accessory support panel has a plurality of vertically spaced apart connectors, and the accessory support panel is connected to the horizontal frame member and extends downwardly across the horizontal brace. An accessory unit is connected to at least a selected one of the connectors.

These and other features, advantages, and objects of the present invention will be further understood and appreciated by those skilled in the art by reference to the following specification, claims, and appended drawings.

BRIEF DESCRIPTION OF THE DRAWINGS

FIG. 2;

FIG. 6 is a perspective view of a second embodiment wherein the accessory board is mounted freestanding on a upright support for use with freestanding worksurfaces and the like.

DETAILED DESCRIPTION OF PREFERRED EMBODIMENTS

Figure 1:
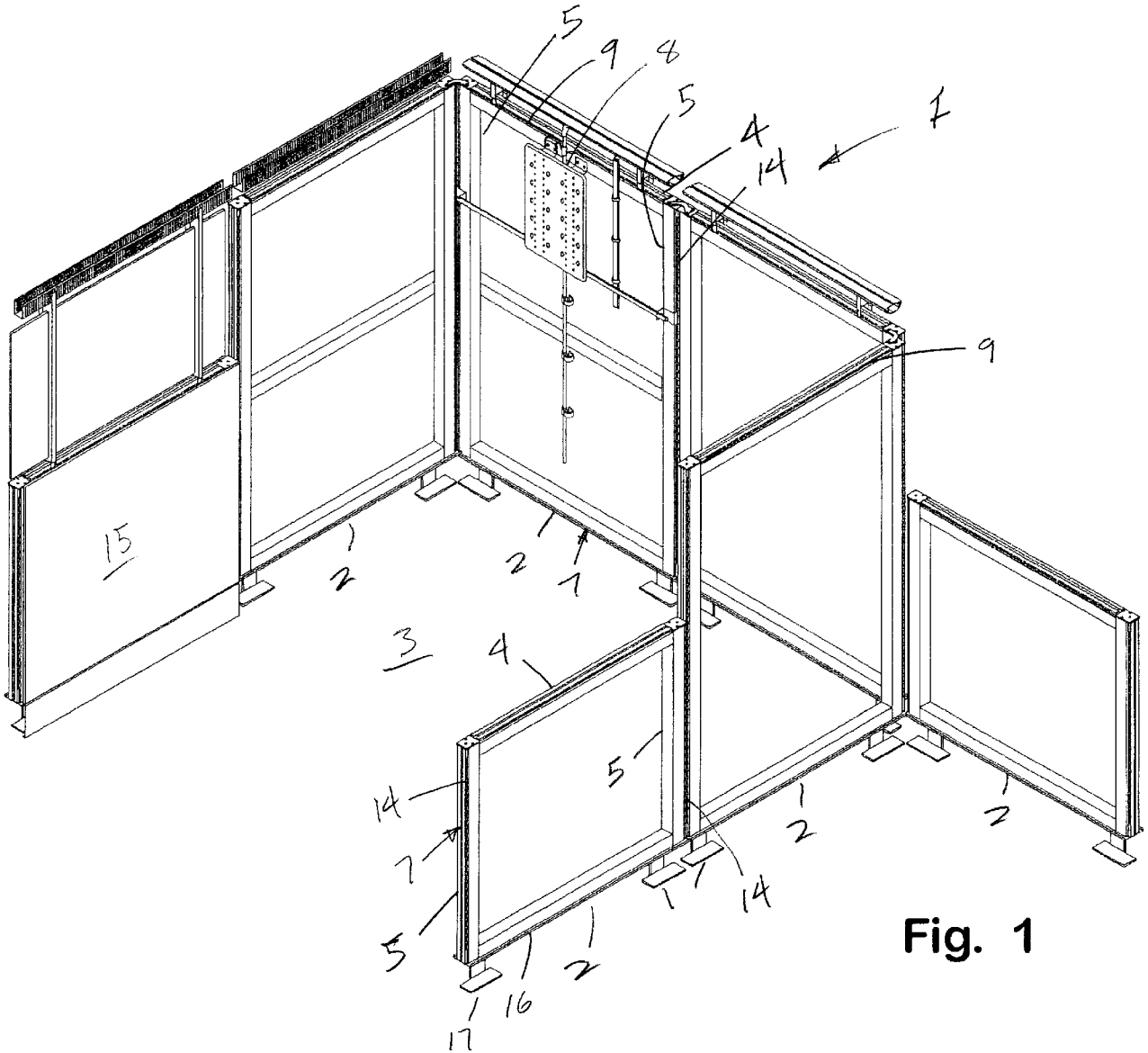
FIG. 1 is a partition system including a worktool arrangement according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions d other physical characteristics relating to the embodiments disclosed herein are not to be,considered as limiting, unless the claims expressly state otherwise.

With reference to FIG. 1, the partition system 1 includes a plurality of partition panels that are interconnected to form a workspace 3. In the illustrated example, a partition panel 2 includes a partition frame 7 having a horizontal frame member 4 and a pair of horizontally spaced apart vertical frame members 5 connected to the horizontal frame member 4. An accessory support 8 is connected to the horizontally extending frame member 4 at a selected one of a row of openings 9 extending along the horizontal frame member 4. The accessory support 8 is connected to the openings 9 to permit adjustable connection of the accessory support 8 at a selected one of a plurality of horizontal locations. The accessory support 8 includes a plurality of vertically spaced apart connectors such as openings 10 (see also FIG. 2) adapted to support an accessory unit such as a shelf 11 or document holder 12 at a selected one of a plurality of vertically spaced locations. Accessory units such as the shelf 11, document holder 12, or cup 13 is removably connected to the accessory support 8 at a selected one of the vertically spaced apart openings 10. The term "accessory unit" as used herein incorporates a wide variety of worktools or other items that may be used with the accessory support 8, such as letter trays, binder holders, hanging file support brackets, computer diskette holder, dishes, telephone caddies, markerboards, pen/pencil cups, powered fans, picture holders, clips, or other items that could be present in a work area.

The present application is related to the following co-pending patent applications, the entire contents of each of which are hereby incorporated herein by reference.

| Application No. | Filing Date | Title |
|---|---|---|
| -------- | Even date herewith | PARTITION PANEL |
| -------- | Even date herewith | PARTITION SYSTEM WITH ELEVATED RACEWAY |
| -------- | Even date herewith | PARTITION PANEL WITH INFILL ARRANGEMENT |
| ------- | Even date herewith | TOP CAP AND SCREEN FOR PARTITIONS |

The horizontal frame member 4 and the vertical frame member 5 have substantially the same cross-sectional shape, and form a vertical row of openings 14, as well as the horizontal row of openings 9. A base horizontal member 16 and glides 17 support the partition panels 2 freestanding on a floor surface. The base and glides 17 are substantially the same as the existing Steelcase AVENIR system, and will not therefor be described in detail herein. The partition frame 7 may be closed off with a cover panel 15. Alternately, the partition frames 7 may be left open if a less private, more open arrangement is desired for a particular application.

Figure 2:
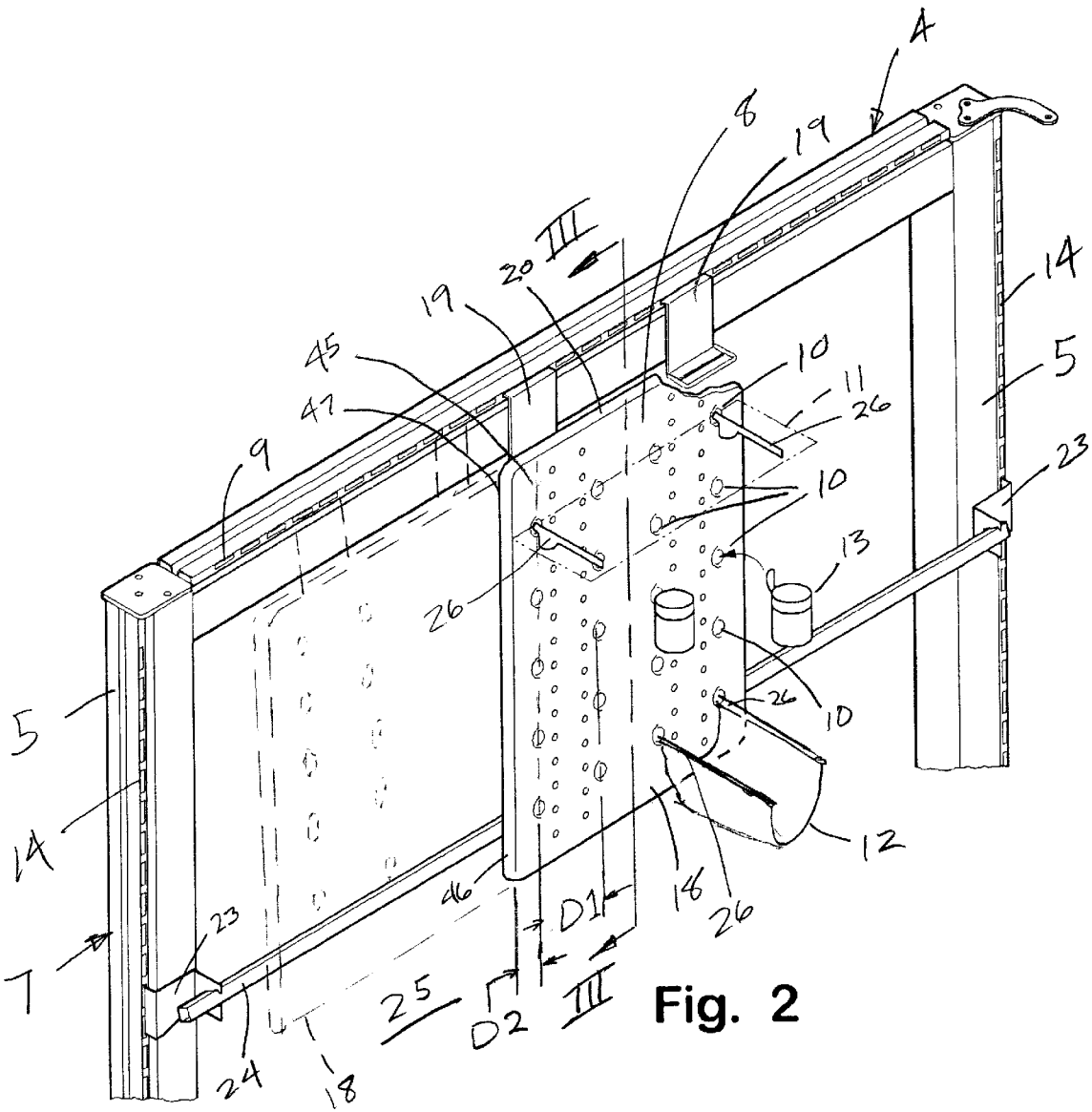
FIG. 2 is a fragmentary, perspective view illustrating the accessory support.
Figure 3:
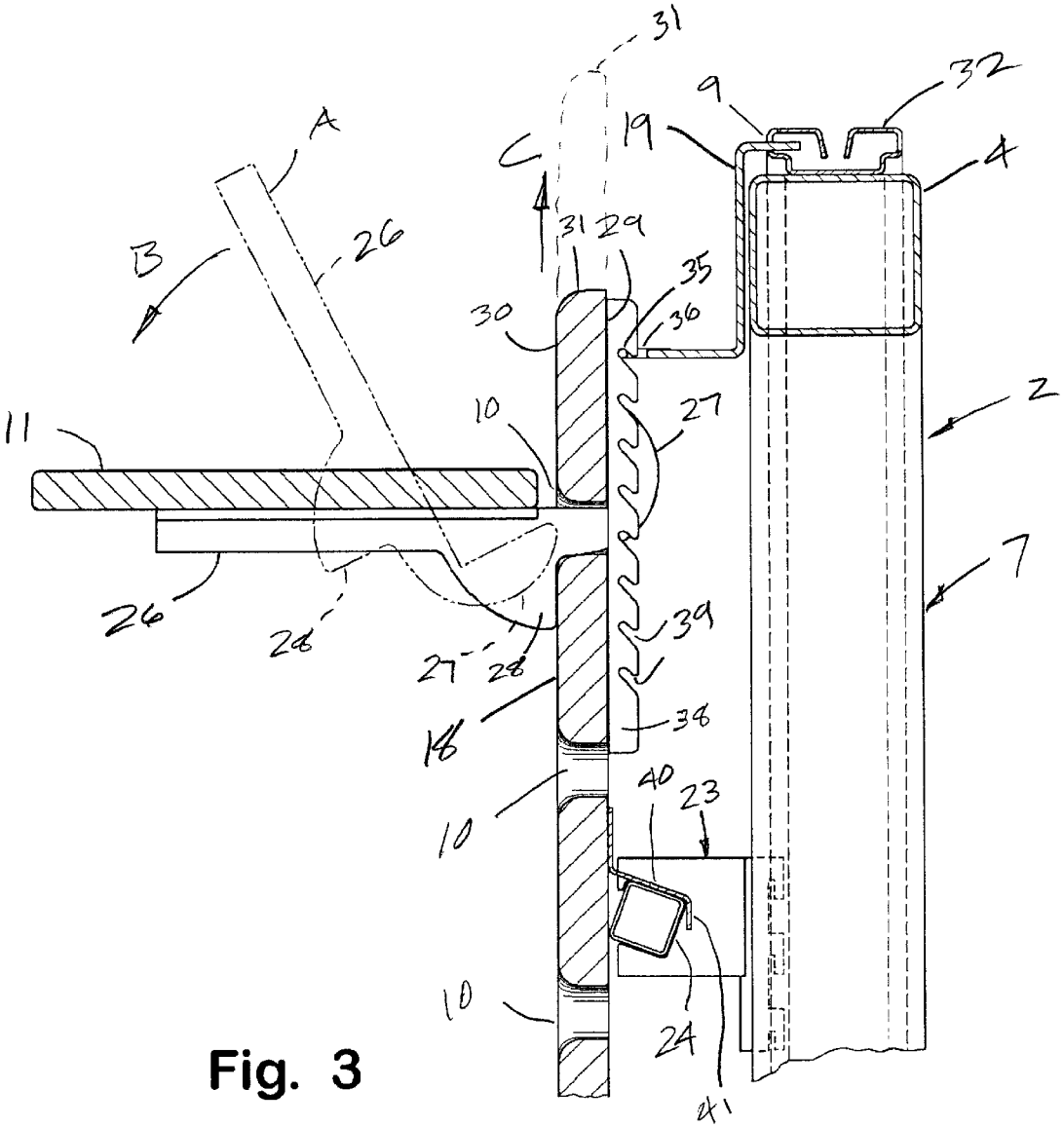
FIG. 3 is a cross-sectional view of the accessory support taken along the line III—III.
Figure 5:
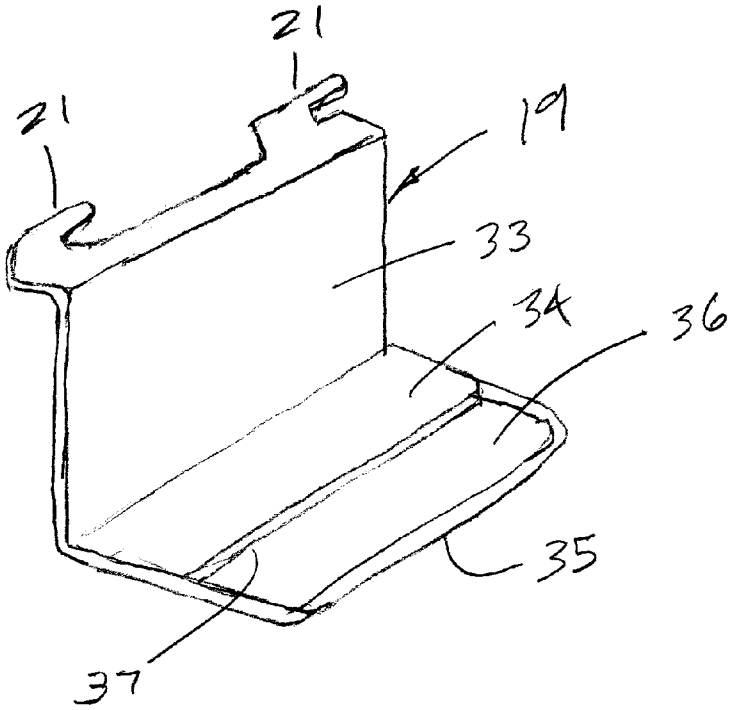
FIG. 5 is a perspective view of a bracket that supports the accessory board of FIG. 2.

With reference to FIG. 2, the accessory support 8 includes an accessory board 18 having a plurality of openings 10 arranged in horizontally spaced apart vertical rows. A pair of hooked brackets 19 are positioned adjacent the upper edge 20 of the accessory board 18, and include hooks 21 (see also FIG. 5) that are received in selected ones of the horizontal row of openings 9 to thereby hang the accessory board 8 from the horizontal upper frame member 4. A pair of hooked brackets 23 support a horizontal brace 24 that extends across the open space 25 defined between the vertical frame members 5. The horizontal brace 24 provides a support, and prevents inward rotation of the accessory board 18 when the frame 7 is used without a cover panel 15. Brace 24 comprises a rectangular tube. In the illustrated example, brace 24 has a length that is about equal to that of the panel 2. However, brace 24 could be substantially longer, such that a single brace 24 could be utilized to support additional accessory boards 18 on adjacent panels 2. With further reference to FIG. 3, the shelf 11 includes a pair of supports 26, each of which includes an upwardly extending brace 27, and a downwardly extending brace 28. When installed, the upwardly extending brace 27 of the support 26 contacts the rear surface 29 of accessory board 18, and the brace 28 simultaneously contacts the front surface 30 of the accessory board 18, thereby preventing downward rotation of the shelf 11. To install the shelf 11 or other accessory, the support 26 is rotated upwardly to the position "A",the brace 27 is inserted into an opening 10. The support 26 is then rotated downwardly in the direction of the arrow "B" until the accessory such as shelf 11 is in the horizontal position. A variety of accessories such as a document holder 12, or cup 13 may utilize a support 26 to removably connect the accessory to the accessory board 18 at a selected one of the openings 10. Each of the accessories can be readily shifted vertically or horizontally to a desired position. If desired for a particular, the accessory board 18 may also be shifted upwardly in the direction of the arrow. "C",such that the upper edge 31 may be positioned substantially above the upper edge 32 of the partition panel 2. With further reference to FIG. 5, bracket 19 includes a vertically extending web 33 and a lower horizontal web 34. A support 35 made from wire or the like extends outwardly beyond the edge 37 of web 34, and forms an open space 36. A vertically elongated mounting bracket 38 (FIG. 3) is mounted to the accessory board 18, and includes a plurality of angled slots 39 that receive the rod 35 of bracket 19 to support the accessory board. Accordingly, the height of the accessory board can be readily adjusted by engaging the rod 35 with the selected one of the angled slots 39. If the upper edge 31 of accessory board 18 is positioned well above the upper edge 32 of partition 2, a bracket 40 may be secured to the accessory board 18. The bracket 40 includes a lower portion 41 that extends downwardly around the horizontal brace 24 to prevent rotation of the accessory board 18 about the rod 35. Bracket 40 need not be utilized in applications wherein the accessory board 18 is positioned substantially below the rod 35, such that the board 18 will not tend to rotate away from the partition 2 and horizontal brace 24.

Figure 4:
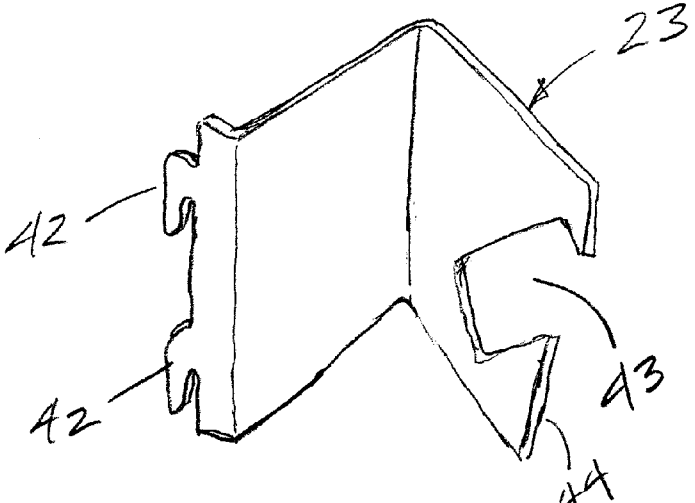
FIG. 4 is a perspective view of the bracket that supports the horizontal brace of FIG. 2.
Figure 6:
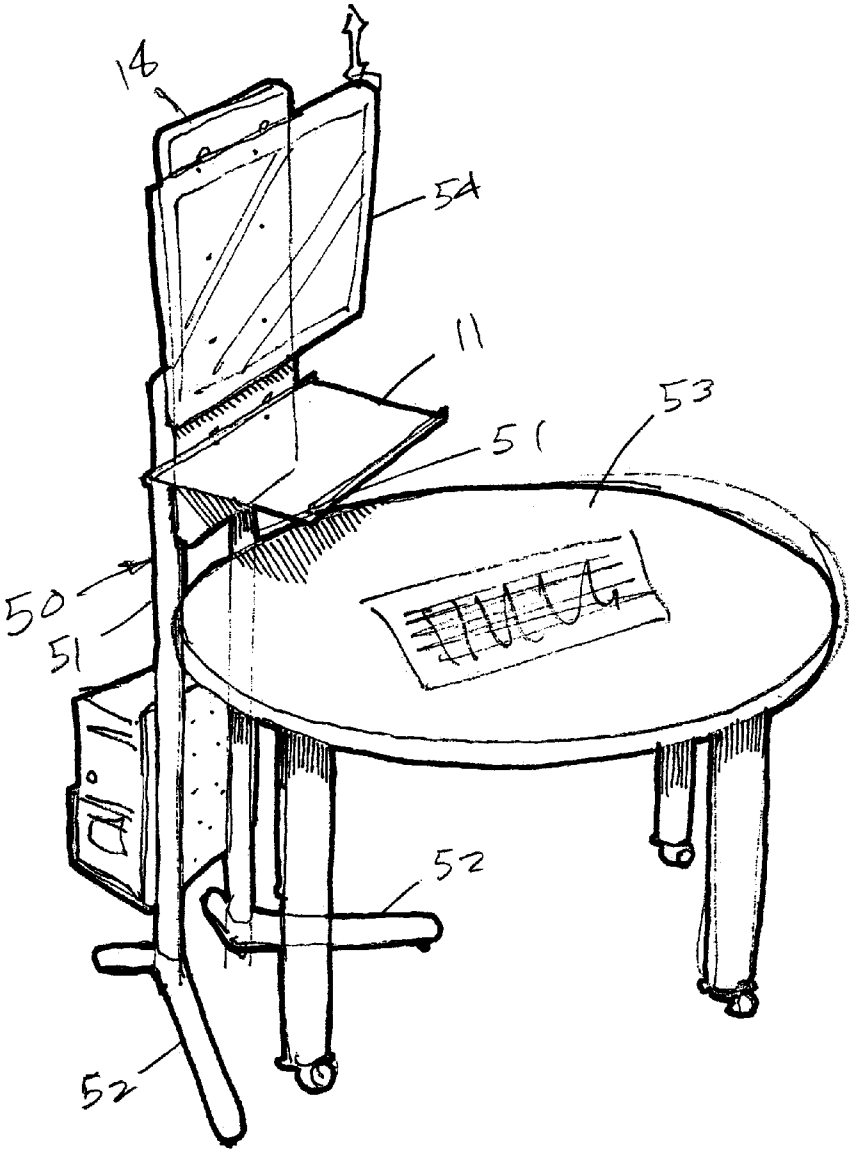

With further reference to FIG. 4, bracket 23 includes hooks 42 that engage the vertical rows of openings 14 in the vertical frame members 5. Horizontal brace 24 comprises a rectangular tube, and the bracket 23 includes a cut-out portion 43 that receives the horizontal brace 24. The horizontal brace 24 may be shifted from side to side within the cut-out 43. A portion of the brace 24 protrudes outwardly beyond the front edge 44, such that the bracket 23 does not interfere with the accessory board when the board 18 is shifted horizontally.

Each row of openings 10 (FIG. 2) is spaced-apart a distance D1. The row 45 of openings 10 adjacent the side edges 46 are located at a distance D2 from the side edge 46. The distance D2 is one-half the distance D1, such that a second accessory board 18 may be placed immediately adjacent the first accessory board 18. An accessory unit may then extend across the "seam" between the two accessory boards 18 due to the common spacing between the rows of openings 10. Preferably, each of the rows of openings 10 on an accessory board 18 are each spaced apart an equal distance D1, thereby permitting horizontal shifting of accessory units when supports 26 spaced-apart distance D1 on a given accessory are utilized. For example, the document holder 12 illustrated in FIG. 2 includes a pair of supports 26 that are substantially the same as the supports 26 illustrated in connection with the shelf 11 in FIG. 3. However, the supports 26 of the document support 12 are spaced apart a distance D1, such that the document support 12 may be shifted horizontally between any one of three positions on the accessory board 18.

With further reference to FIG. 5, an accessory board 18 may also be mounted to an upright stand 50 having a pair of upright tubes 51, and a pair of base supports 52 that support the stand 50 in an upright position. The stand 50 may be placed adjacent a freestanding worksurface such as a table 53 to provide a shelf 11, or other accessory 54. The accessory board 18 illustrated in FIG. 5 has substantially the same configuration as the accessory board 18 illustrated in FIG. 2, such that the various accessory units may be positioned in a desired vertical location.

The accessory support of the present invention may be readily shifted in a horizontal direction along the partition frame as required for a particular application. Furthermore, the accessory board may be vertically shifted, and the various accessories may also be vertically shifted on the accessory board. The horizontal cross brace supports the accessory board, without requiring a cover panel that would otherwise close off the partition frame.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition panel for offices, comprising:

a partition frame including a horizontal frame member and a pair of horizontally spaced apart vertical frame members connected to said horizontal frame member; said partition frame including an opening through a central portion thereof;

an accessory support connected to said horizontally extending frame member at a selected one of a plurality of horizontal locations to permit side-to-side horizontally adjustable connection of said accessory support to said horizontal frame member, said accessory support including a plurality of vertically spaced apart connectors adapted to support an accessory unit at a selected one of a plurality of vertically spaced locations;

an accessory unit removably connectable to said accessory support at a selected one of said vertically spaced apart connectors in a vertically repositionable manner; and a horizontal brace connected to said vertical frame members and extending across said opening, a lower portion of said accessory support engaging said horizontal brace to prevent rotation of said accessory support.

2. The partition panel set forth in claim 1, wherein:

said vertical frame members include a vertical row of openings; and said horizontal brace includes a pair of hooked brackets engaging selected ones of said openings such that said horizontal brace is vertically adjustable.

3. A partition panel for offices, comprising:

a partition frame including a horizontal frame member and a pair of horizontally spaced apart vertical frame members connected to said horizontal frame member; said partition frame including an opening through a central portion thereof;

an accessory support connected to said horizontally extending frame member at a selected one of a plurality of locations to permit adjustable connection of said accessory support to said horizontal frame member, said accessory support including a plurality of vertically spaced apart connectors adapted to support an accessory unit at a selected one of a plurality of vertically spaced locations;

an accessory unit removably connected to said accessory support at a selected one of said vertically spaced apart connectors;

a horizontal brace connected to said vertical frame members and extending across said opening, a lower portion of said accessory support engaging said horizontal brace to prevent rotation of said accessory support; and wherein:

said horizontal frame member extends along an upper edge of said partition frame, and an upper portion of said accessory support extends upwardly above said horizontal frame.

4. A partition panel for offices, comprising:

a partition frame including a horizontal frame member and a pair of horizontally spaced apart vertical frame members connected to said horizontal frame member;

an accessory support comprising a generally planar sheet, said accessory support connected to said horizontally extending frame member at a selected one of a plurality of locations to permit horizontal, side-to-side adjustable connection of said accessory support to said horizontal frame member, said accessory support including a plurality of vertically spaced apart openings forming at least one vertical row adapted to support an accessory unit at a selected one of a plurality of vertically spaced locations;

an accessory unit removably connected to said accessory support at a selected one of said vertically spaced apart openings.

5. A partition for offices, comprising:

a partition frame having a base configured to abuttingly support said partition frame freestanding on a floor surface, said partition frame further including a pair of vertically extending frame members and a horizontal frame member extending therebetween, each vertically extending frame member having a vertical row of openings, said partition frame having an enlarged opening therethrough between said vertically extending frame members and below said horizontal frame member;

a horizontal brace extending across said enlarged opening, said horizontal brace vertically spaced below said horizontal frame member to define a gap therebetween, said horizontal brace releasably connected to selected ones of said vertical row of openings; and an accessory support member connected to said horizontal frame member, the accessory support member extending vertically from said horizontal frame member across said gap and abutting said horizontal brace.

6. The partition set forth in claim 5, wherein:

said accessory support member includes a generally planar sheet having a plurality of openings therethrough configured to support accessory units.

7. The partition set forth in claim 6, wherein:

said horizontal frame member includes a horizontal row of openings, and said accessory support engaging at least a selected one of said horizontal row of openings.

8. A partition, comprising:

a generally rectangular partition frame having first and second spaced apart vertical frame members and a horizontal frame member and an opening through a central portion thereof between said first and second vertical frame members and below said horizontal frame member, said opening defining a first width;

a horizontal brace secured to said partition frame and extending across said opening;

a generally vertical planar accessory support panel having a side edge and a plurality of vertically spaced apart connectors, said accessory support panel connected to said horizontal frame member and extending downwardly across said horizontal brace, said accessory support panel defining a second width that is substantially less than said first width such that said side edge is spaced apart from said first vertical frame member to form a gap therebetween; and an accessory unit connected to at least a selected one of said connectors.

9. The partition set forth in claim 8, wherein:

said vertical frame members each include a vertical row of openings; and said horizontal brace is secured to selected ones of said openings.

10. The partition set forth in claim 9, including:

a pair of hooked brackets, each engaging a selected one of said vertical rows of slots, said horizontal brace slidably supported by said brackets to permit horizontal shifting of said horizontal brace.

11. The partition set forth in claim 8, wherein:

said accessory support includes a plurality of vertically spaced apart openings; and said accessory unit includes an extension received in at least a selected one of said openings to removably connect said accessory unit to said accessory support unit.

12. The partition set forth in claim 8, wherein:

said accessory unit comprises a shelf.

13. The partition set forth in claim 8, wherein:

said accessory unit comprises a document support.

* * * * *

UNITED STATES PATENT AND TRADEMARK OFFICE

CERTIFICATE OF CORRECTION

PATENT NO. : 6,625,935 B1
DATED : September 30, 2003
INVENTOR(S) : Jonathan J. King et al.

It is certified that error appears in the above-identified patent and that said Letters Patent is hereby corrected as shown below:

Column 1,
Line 16, delete “to” before “processing”;

Column 3,
Line 34, “d” should be -- and --;
Line 35, after “be” delete “,”; and

Column 6,
Line 57, after “frame” insert -- member --.

Signed and Sealed this

Fifteenth Day of June, 2004

JON W. DUDAS
*Acting Director of the United States Patent and Trademark Office*